US008419083B2

(12) United States Patent
Burmesch

(10) Patent No.: US 8,419,083 B2
(45) Date of Patent: Apr. 16, 2013

(54) ELECTROMECHANICAL LOCKS AND LATCHING ARRANGEMENTS

(75) Inventor: Gary Burmesch, Port Washington, WI (US)

(73) Assignee: Master Lock Company LLC, Oak Creek, WI (US)

( * ) Notice: Subject to any disclaimer, the term of this patent is extended or adjusted under 35 U.S.C. 154(b) by 665 days.

(21) Appl. No.: 12/604,469

(22) Filed: Oct. 23, 2009

(65) Prior Publication Data

US 2010/0102572 A1 Apr. 29, 2010

Related U.S. Application Data

(60) Provisional application No. 61/108,203, filed on Oct. 24, 2008.

(51) Int. Cl.
*E05C 1/06* (2006.01)
*E05B 49/00* (2006.01)

(52) U.S. Cl.
USPC ..... 292/144; 292/341.17; 70/278.1

(58) Field of Classification Search ..... 292/1, 64, 292/137, 138, 140, 144, 145, 153, 163, 169, 292/175, 341.15, 341.17, DIG. 4, DIG. 60, 292/340; 70/103, 104, 113, 150, 275, 278.1, 70/278.7, 469
See application file for complete search history.

(56) References Cited

U.S. PATENT DOCUMENTS 62,136 A * 2/1867 James ..... 292/210
1,070,580 A * 8/1913 Breithaupt ..... 292/341.17
1,323,007 A * 11/1919 Brunette ..... 160/290.1
1,459,701 A * 6/1923 Willis ..... 292/341.17
2,012,341 A * 8/1935 Eras ..... 292/341.12
2,156,004 A * 4/1939 Vanderlinde ..... 292/192
2,494,754 A * 1/1950 Goughnour ..... 292/159
2,538,552 A * 1/1951 Beery ..... 292/1
2,607,618 A * 8/1952 Ernest ..... 292/1
3,799,591 A * 3/1974 Taniyama ..... 292/71
4,262,504 A * 4/1981 Inoue ..... 70/151 R
4,656,850 A * 4/1987 Tabata ..... 70/276
5,307,656 A * 5/1994 Gartner et al. ..... 70/277
5,588,318 A * 12/1996 Osborne ..... 70/469
5,678,868 A * 10/1997 Williams et al. ..... 292/144
5,715,712 A * 2/1998 West ..... 70/257
6,010,168 A * 1/2000 Johnson ..... 292/341.17
6,094,953 A * 8/2000 Evans ..... 70/278.1
(Continued)

OTHER PUBLICATIONS

International Search Report and Written Opinion from International Application No. PCT/US09/61762, date of mailing Jan. 13, 2010.

*Primary Examiner* — Carlos Lugo
*Assistant Examiner* — Alyson M Merlino
(74) *Attorney, Agent, or Firm* — Calfee, Halter & Griswold LLP

(57) ABSTRACT

An electrically operable latch includes a housing and a latch member assembled with the housing for movement between an extended position and a retracted position. A blocker member is disposed in the housing and adapted to block movement of the latch member to the retracted position when the blocker member is in a first position, and to permit movement of the latch member from the extended position to the retracted position when the blocker member is in a second position. An actuator member is disposed in the housing and adapted to move the blocker member from the first position to the second position in response to an electrical signal supplied to the actuator member.

21 Claims, 8 Drawing Sheets

U.S. PATENT DOCUMENTS

| | | | | |
|---|---|---|---|---|
| 6,601,418 | B2 * | 8/2003 | Huang | 70/280 |
| 6,666,054 | B1 * | 12/2003 | Hsieh | 70/257 |
| 7,416,228 | B2 * | 8/2008 | Pfitzinger et al. | 292/216 |
| 2003/0172694 | A1 | 9/2003 | Miller et al. | |
| 2005/0207087 | A1 | 9/2005 | Fisher et al. | |
| 2006/0179903 | A1 | 8/2006 | Goldman | |
| 2007/0245784 | A1 | 10/2007 | Geringer et al. | |

* cited by examiner

ELECTROMECHANICAL LOCKS AND LATCHING ARRANGEMENTS

CROSS-REFERENCE TO RELATED APPLICATION

This application claims the benefit of U.S. Provisional Patent Application Ser. No. 61/108,203, entitled ELECTROMECHANICAL LOCKS AND LATCHING ARRANGEMENTS and filed Oct. 24, 2008, the entire disclosure of which is incorporated herein by reference, to the extent that it is not conflicting with the present application.

BACKGROUND

Conventional locking mechanisms, such as, for example, locks for cabinet doors and drawers, often employ a mechanical latch that lockingly engages a catch to secure a structure (e.g., a door or a drawer) in a locked condition. In such a locking mechanism, proper manipulation of a lock interface (e.g., a key cylinder lock or combination lock) enables the latch to be moved out of locking engagement with the catch to permit opening of the door or drawer. In some cases, the use of conventional mechanical lock interfaces results in inconveniences or security risks for the user, such as, for example, when access to the locked structure must be extended, restricted or otherwise changed. For example, in the case of a key-operated lock, loss of a key may present a security risk and may result in the need to re-key or replace the lock. In the case of a mechanical combination lock, a change in the individuals authorized to access the locked structure may require physically re-coding the combination or replacing the lock, and an unauthorized user may surreptitiously discover the combination code.

SUMMARY

The present application describes inventive electromechanical latching arrangements which may be utilized to restrict movement of a first object or structure (e.g., a door or drawer) with respect to a second object or structure (e.g., a door frame or enclosure). In one embodiment of the present application, a latch may be configured to be electrically operable between a locking condition, in which movement of a latch member is blocked, and an unlocked condition, in which movement of the latch member is permitted to separate the latch from a corresponding catch member.

Accordingly, in one embodiment, an electrically operable latch includes a housing and a latch member assembled with the housing for movement between an extended position and a retracted position. A blocker member is disposed in the housing and adapted to block movement of the latch member to the retracted position when the blocker member is in a first position, and to permit movement of the latch member from the extended position to the retracted position when the blocker member is in a second position. An actuator member is disposed in the housing and adapted to move the blocker member from the first position to the second position in response to an electrical signal supplied to the actuator member.

BRIEF DESCRIPTION OF THE DRAWINGS

Features and advantages of the invention will become apparent from the following detailed description made with reference to the accompanying drawings, wherein.

DETAILED DESCRIPTION

Figure 1:
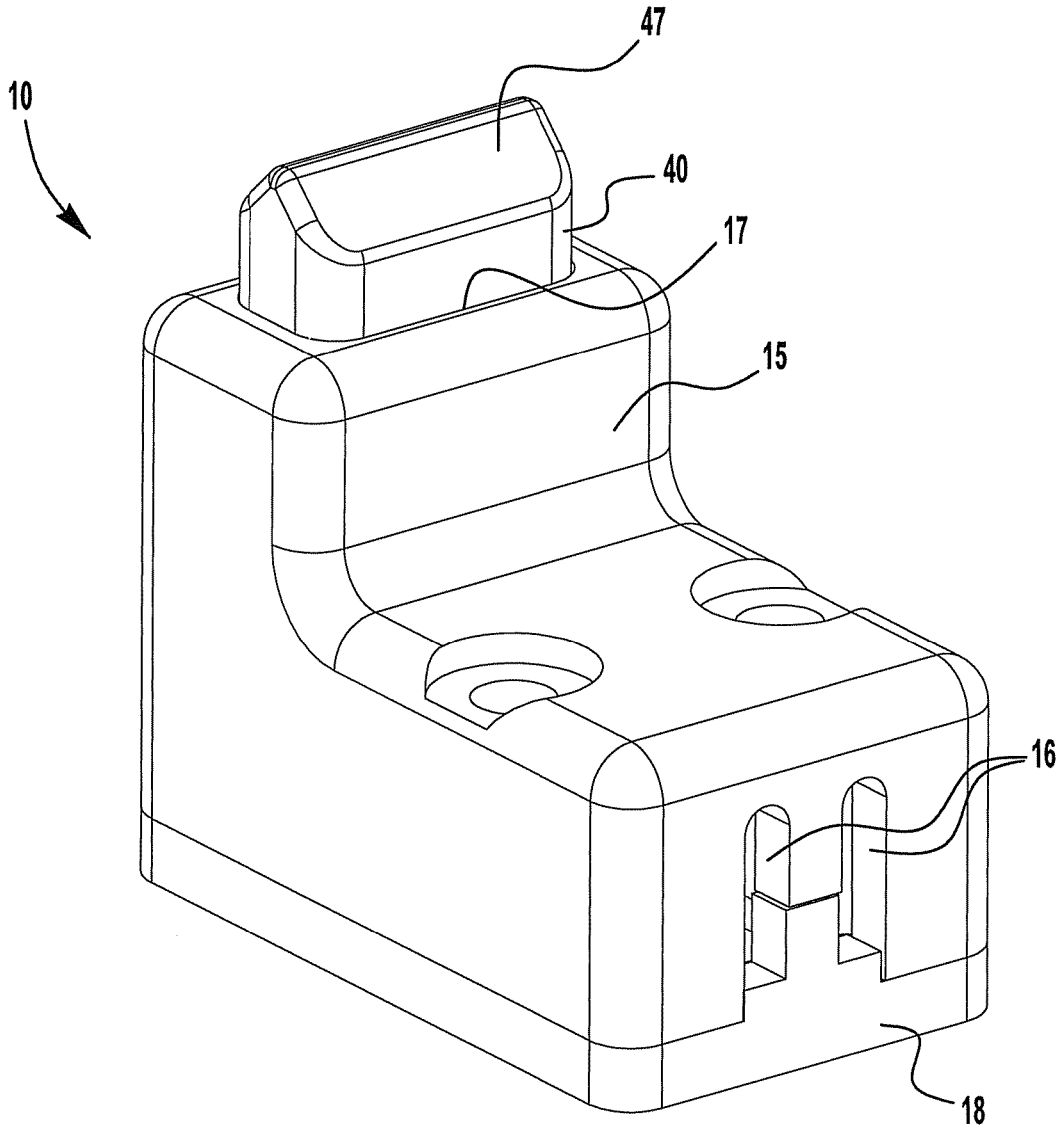
FIG. 1 illustrates a rear perspective view of an electromechanical latch assembly.
Figure 2:
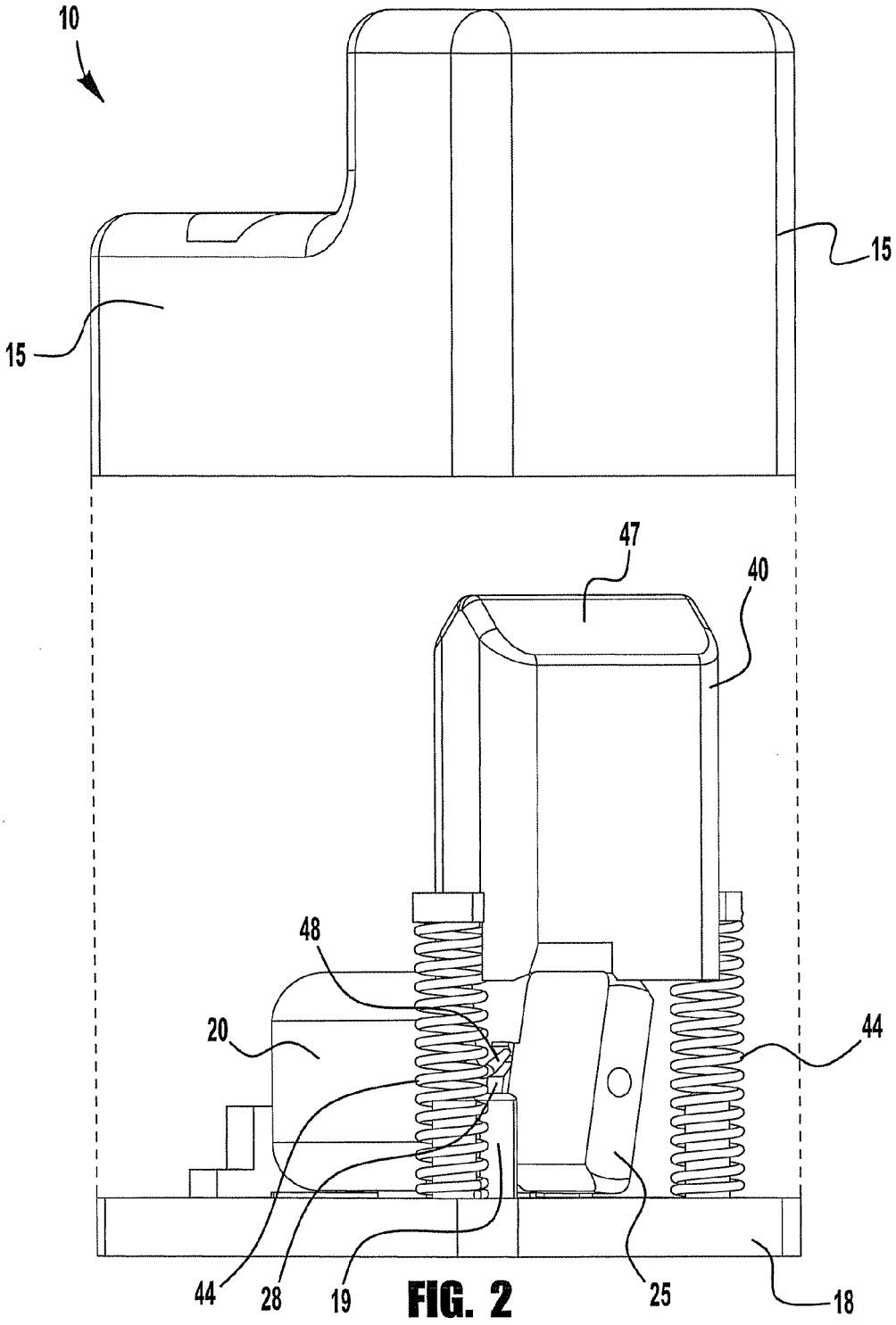
FIG. 2 illustrates a partially exploded front perspective view of the electromechanical latch assembly of FIG. 1.
Figure 3:
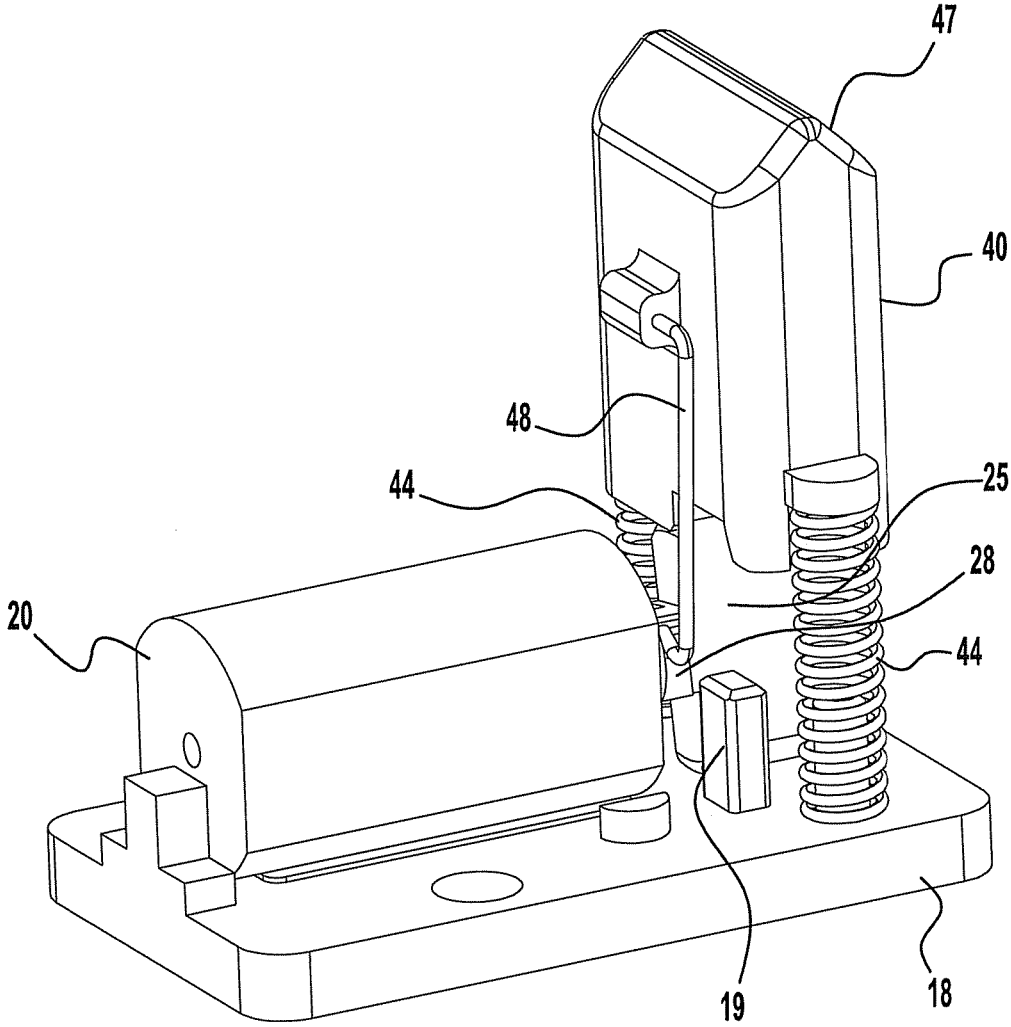
FIG. 3 illustrates a side perspective view of the electromechanical latch assembly of FIG. 1, with the housing removed to illustrate additional features of the latch assembly.
Figure 4:
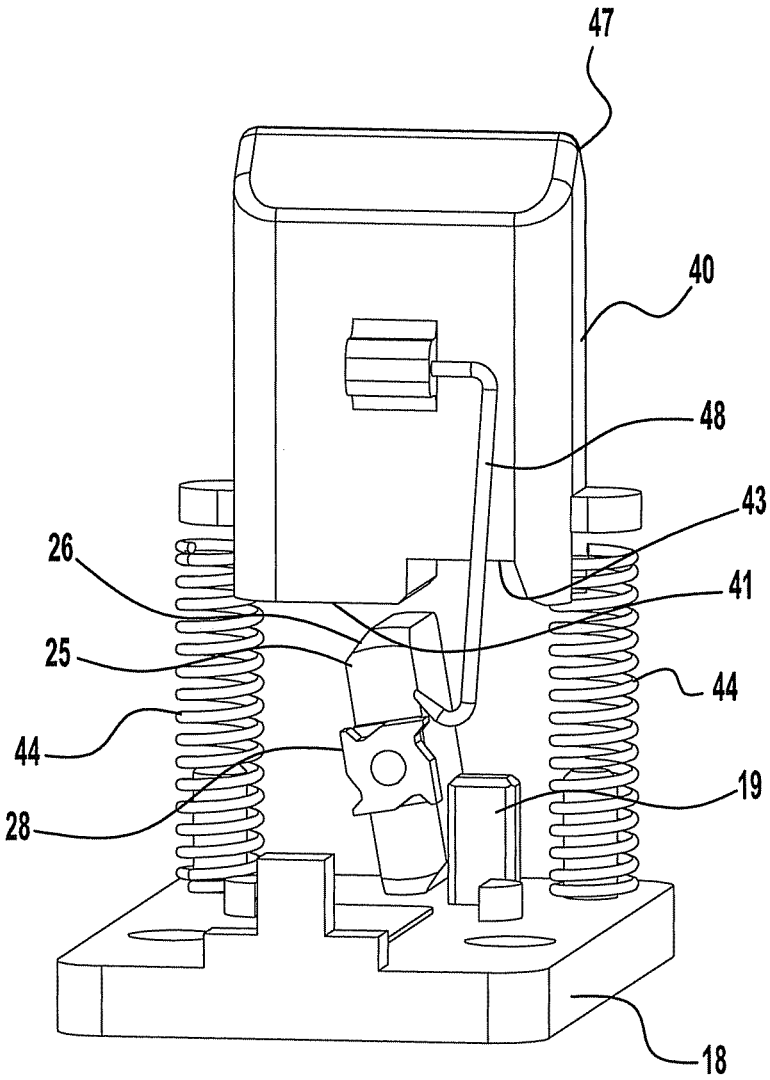
FIG. 4 illustrates a rear perspective view of the electromechanical latch assembly of FIG. 1, with the housing and motor removed to illustrate additional features of the latch assembly.

This Detailed Description merely describes embodiments of the invention and is not intended to limit the scope of the claims in any way. Indeed, the invention as claimed is broader than, and unlimited by, the preferred embodiments, and the terms used in the claims have their full ordinary meaning. For example, while the embodiments described herein relate to electronic locking arrangements for a cabinet, the inventive features may be utilized in many different types of locks for doors, containers, lockers, or other such structures.

The present application describes locking arrangements which may be provided for securing a first structure (such as, for example, a cabinet door) to a second structure (such as, for example, a cabinet enclosure), in which a latch is secured in a locking condition, thereby impeding unauthorized retraction or disengagement of the latch from a catch member or other interlocking feature of the second structure. According to an aspect of the present application, the latch, when in an unlocked condition, may be movable from a catch engaging or extended position to a catch disengaging or retracted position to permit separation of the latch from the catch member, for example, to open a cabinet door.

While many types of locking mechanisms may be utilized to selectively secure and release a latch to limit access to a lockable structure, in one embodiment, an electrically operable locking mechanism may be provided. In such an embodiment, an electrical signal supplied to the locking mechanism in response to an authorized user input or other electronic prompt moves the locking mechanism to an unlocked condition to permit movement of the latch to a catch disengaging or release condition. Many different types of electrically operable mechanisms may be utilized, including, for example, electrical actuators, electrical switches, motors (linear or screw drive), shape memory alloy devices (e.g., a device using MUSCLE WIRES® or NANOMUSCLE® shape memory alloys), or solenoids (linear or rotary). The electrical signal may be supplied, for example, by an electronic keypad, biometric sensor, magnetic key card reader, wireless transceiver, or other such electronic lock interface connected with the electrically operable mechanism and configured to deliver the electrical signal in response to the receipt of an authorized data signal. Additionally or alternatively, an electronic signal may be supplied automatically (i.e., without input from an authorized user) in response to a pre-identified condition, such as, for example, a time setting, an emergency alert signal, or proximity to a wireless signal transmitting device.

While an electrically operable mechanism may be configured to mechanically move a latch out of interlocking engagement with a corresponding catch member, in another embodiment, the electrically operable mechanism may be configured to block movement of the latch in a locked condition, and allow movement of the latch in an unlocked condition. In one such embodiment, the electrically operable mechanism may be provided with a blocking member that is positioned to obstruct movement of the latch when the electrically operable mechanism is in the locked condition, and is moved to a position that allows movement of the latch when the electrically operable mechanism is in the unlocked condition. In this unlocked condition, a (direct or indirect) user applied force on the latch causes the latch to move to a catch disengaging or retracted position to allow the unlocked structure to be opened or otherwise accessed. By utilizing user applied forces to move the latch (instead of the electrically operable mechanism), power consumption by the electrically operable mechanism may be minimized, allowing for longer battery life and/or a smaller power source.

FIGS. 1-4 illustrate various views of an exemplary electrically operable latch assembly 10, in accordance with inventive features of the present application. As shown, the latch assembly 10 includes a housing 15 and base 18 for enclosing an electrically operable motor 20 (FIGS. 2 and 3), and a latch member 40 extending through an opening 17 in the housing 15 (FIG. 1) for engagement with a catch member (such as, for example, the catch assembly 60 of FIGS. 5-7, described in greater detail below). The housing 15 may include openings 16 for electrical wiring (not shown) for receiving an electrical signal to operate the motor 20, for example, in response to an authorized user input. In other embodiments, the latch assembly may include an internal power source and a transceiver (e.g., infrared, radio or BLUETOOTH®) for receiving wireless signals for operation of the motor (or other such electrically operable mechanism).

The motor 20 of the exemplary embodiment is a rotary motor configured to rotate a shaft a predetermined amount (e.g., 90°) in response to receipt of an electrical signal. The shaft (not shown) is connected to a blocking member 25 for rotation of the blocking member from a latch member blocking position to a latch member releasing position. In the latch member blocking position, an end portion 26 of the blocking member 25 (FIG. 4) engages a bottom surface 41 of the latch member 40 to secure the latch member 40 in an extended or catch engaging position. When the motor 20 is activated to rotate the shaft (e.g., in response to an authorized user prompt), the blocking member 25 is rotated to a latch member releasing position, in which the end portion 26 of the blocking member 25 is lowered to allow the latch member 40 to partially retract into the housing 15 for disengagement from the corresponding catch.

While a latch member may be permitted to automatically drop out of engagement with the catch upon rotation of the blocking member, in one embodiment, one or more biasing members may be provided to bias the latch member into the extended or catch engaging position until a downward force (i.e., against the biasing force) is applied to the latch member. In the illustrated embodiment, spring members 44 are positioned between the base 18 and the sides of the latch member 40 to bias the latch member toward the extended or catch engaging position. The latch member 40 includes a tapered or angled upper portion 47, such that a lateral force applied to the upper portion 47 (e.g., a force applied by the catch when a user pulls the door and catch away from the latch) forces the latch member downward against the spring members 44 to disengage from the catch. In the exemplary embodiment, the upper portion 47 is substantially V-shaped.

To return a latching mechanism to a locking condition (with the latch member secured in a catch engaging position), an electrically operable mechanism may be configured to return a blocking member to a latch member blocking condition. For example, a motor may be provided with a button or switch that reverses polarity of the motor to rotate the shaft in the opposite direction. Reverse rotation of the motor to return the latching mechanism to the locking condition may be initiated, for example, by an authorized user input or by an automatic control mechanism (e.g., a timing circuit that "relocks" the latching mechanism after a predetermined time period). In another embodiment, a latch assembly may be configured to mechanically return the latching mechanism to the locking condition automatically, for example, after the latch member has disengaged and separated from a corresponding catch. For example, a latch member may be provided with a blocker return member that engages the blocking member to return the blocking member to the latch member blocking position when the latch member returns to the extended or catch engaging position (e.g., due to biasing forces of spring members).

In the illustrated embodiment, a resilient blocker return member or hook 48 extends from the latch member 40 toward the blocking member 25. When the latching assembly is unlocked and the latch member 40 is retracted to disengage from the corresponding catch, the hook 48 flexes and is pushed past a hook engaging portion 28 of the blocking member 25. When the disengaged latch member 40 is returned to the extended position by the spring members 44, the hook 48 engages the hook engaging portion 28 of the blocking member 25 and rotates the blocking member 25 back to the latch member blocking position. While many different types of hook engaging portions may be provided, in the illustrated embodiment, the hook engaging portion 28 forms an angled tooth shaped to outwardly flex the hook 48 as the hook is directed downward, and shaped to engage the end of the hook 48 as the hook is directed upward, for rotation of the blocking member 25. A notch or recess 43 may be provided in the bottom portion of the latch member 40 to provide clearance for the rotating blocking member 25. A post 19 or other such obstruction may extend from the base 18 to prevent rotation of the blocking member 25 beyond the latch member blocking position in the return direction.

Many different types of catch assemblies may be utilized with a latching mechanism (such as, for example, an electrically operable latching mechanism) to interlock with the secured latch member. In one embodiment, a catch assembly includes a catch member that is moveable in a first direction to facilitate re-engagement with the latch member when the latch member is returned to engagement with the catch assembly, while being secured against movement in a second, opposite direction to prevent lateral separation of the latch member from the catch (i.e., requiring axial or longitudinal retraction of the latch member for lateral separation from the catch).

Figure 5:
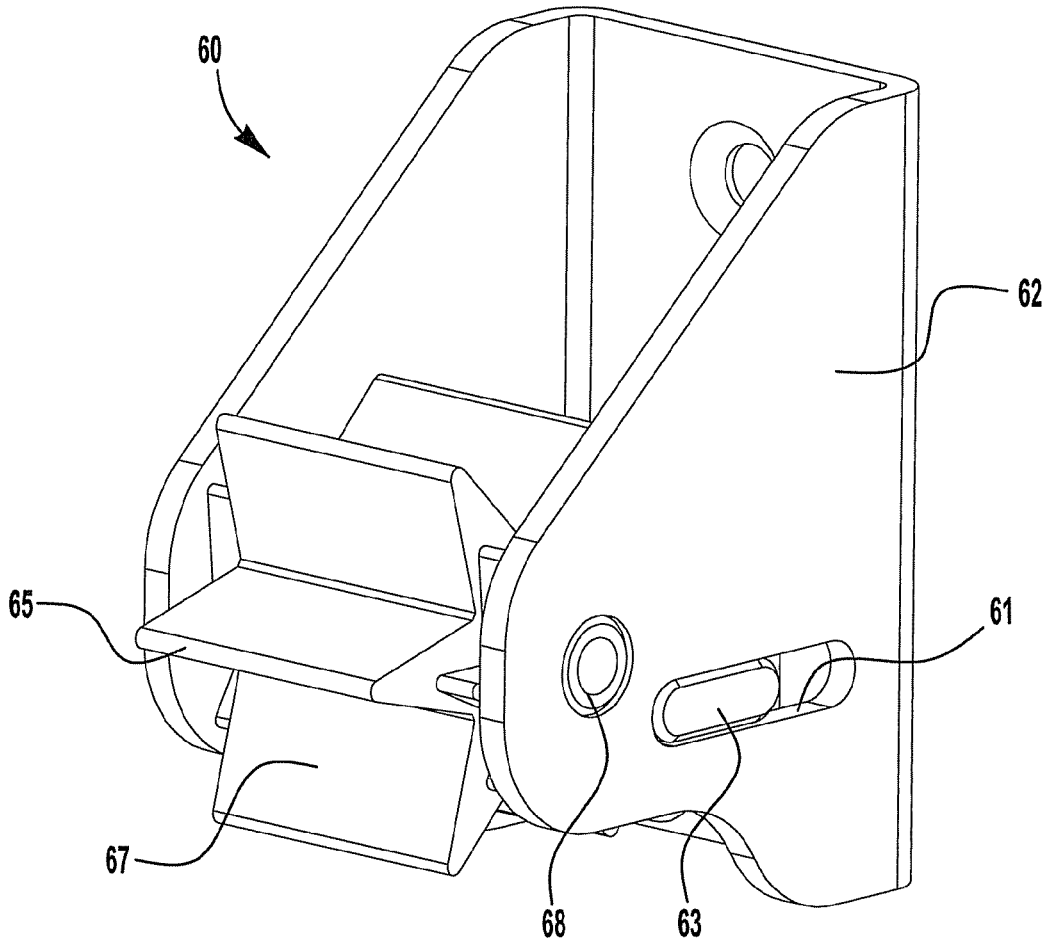
FIG. 5 illustrates a front perspective view of a ratcheting catch assembly for use with a latch.
Figure 6:
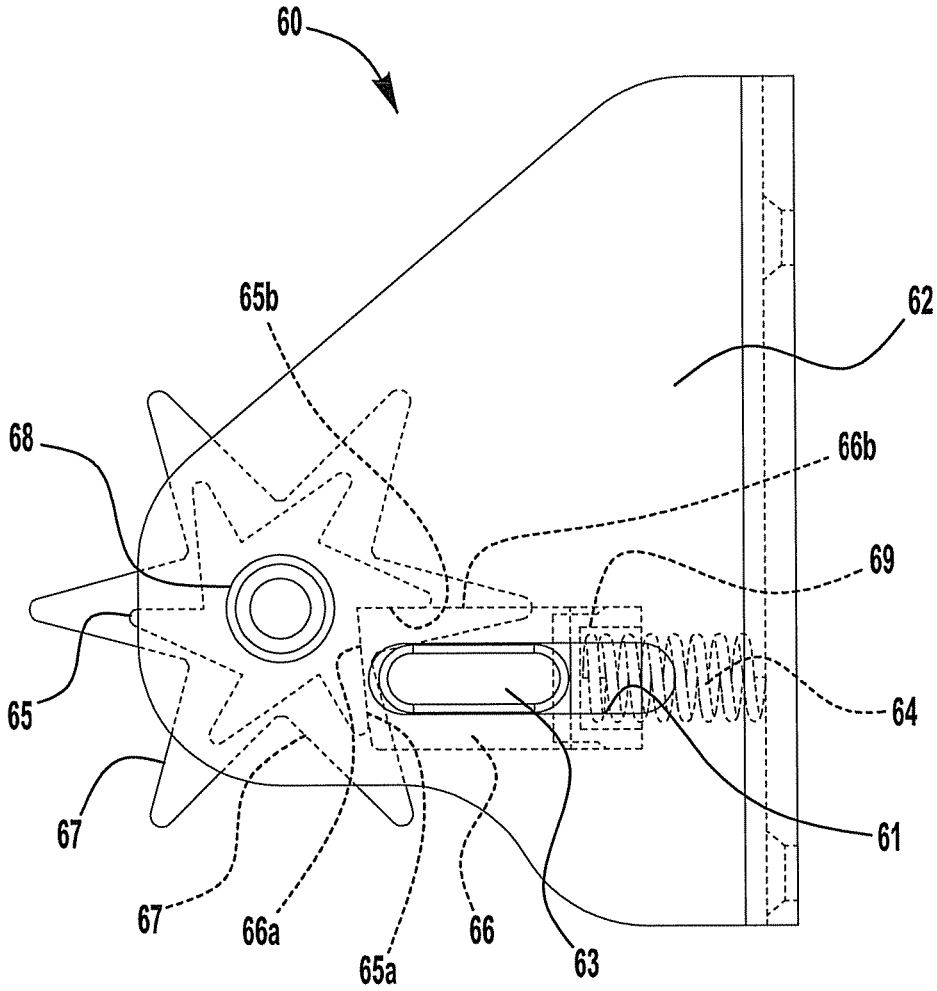
FIG. 6 illustrates a side view of the catch assembly of FIG. 5, with hidden portions shown in phantom to illustrate additional features of the catch assembly.
Figure 7:
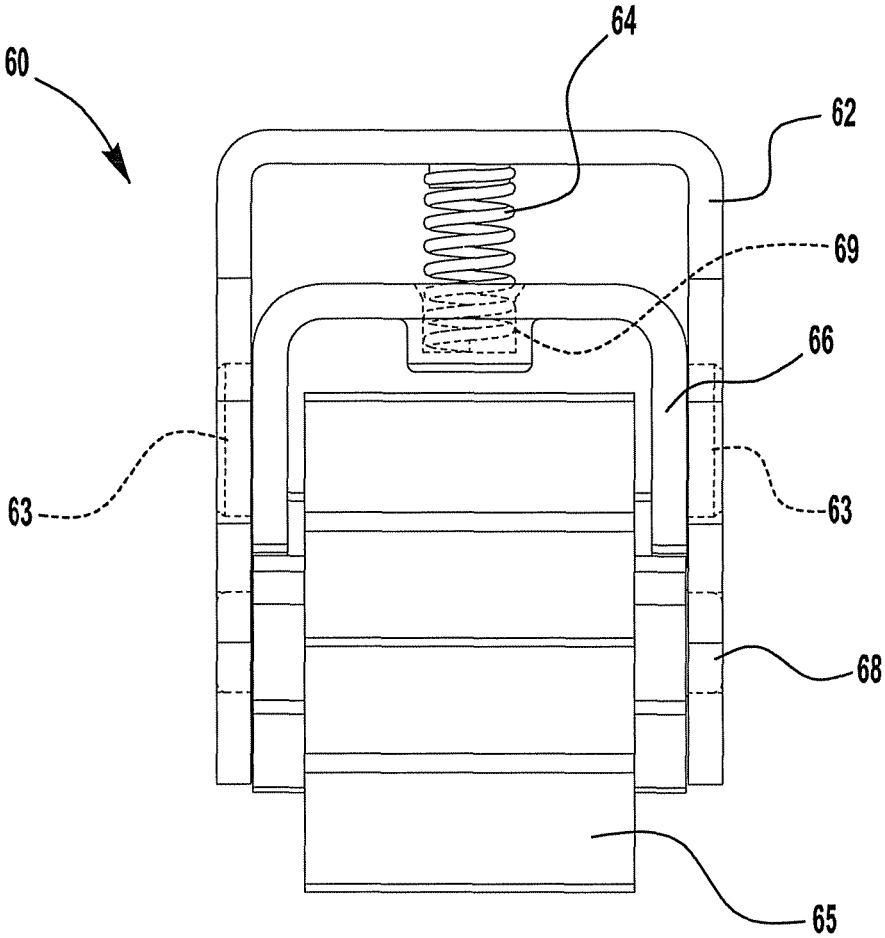
FIG. 7 illustrates a top view of the catch assembly of FIG. 5, with hidden portions shown in phantom to illustrate additional features of the catch assembly.

FIGS. 5-7 illustrate an exemplary catch assembly 60 having a bracket portion 62 for securing (e.g., using glue, machine screws, or other fasteners) the catch assembly 60 to a structure (e.g., a door or drawer), and a rotatable catch member 65 having one or more latch engaging portions 67 shaped to engage an end or upper portion of a latch member (e.g., the latch member 40 of the assembly 10 of FIGS. 1-4). In the exemplary embodiment, the catch member 65 is a star-shaped gear; however, other shapes and configurations may also be employed.

The exemplary catch member 65 is rotatably mounted to the bracket portion 62 by a gear pin 68 (although other mounting configurations may be utilized). As shown, the catch member 65 is configured to rotate freely in a counter-clockwise direction (when viewed with the bracket portion 62 on the right hand side), while being secured against rotation in the clockwise direction. While many different mechanisms may be utilized to limit rotation of a catch member to one direction, in the illustrated embodiment, as shown in FIG. 6, a spring-biased slide member 66 is biased into engagement with the catch member 65 by spring 64. First interengaging surfaces 65*a*, 66*a* of the catch member 65 and slide member 66 are oriented such that a counter-clockwise rotational force on the catch member 65 pushes the slide member 66 against the spring 64, allowing the interengaging surface 65*a* of the catch member 65 to rotate past the slide member 66 for engagement of an adjacent interengaging surface 65*a* with the slide member 66. Second interengaging surfaces 65*b*, 66*b* are oriented such that a clockwise rotational force on the catch member 65 does not move the slide member 66, thereby blocking clockwise rotational movement of the catch member 65. In the exemplary embodiment, the second interengaging surface 65*b* of the catch member 65 is substantially coplanar with a central axis of the catch member, and the second interengaging surface 66*b* of the slide member 66 is substantially parallel to the biasing force of the spring 64. As a result, a clockwise rotational force applied to the catch member 65 will not move the slide member 66 against the spring 64, as the rotational force will be directed perpendicular to the spring force. The spring 64 may be seated in a recessed portion 69 of the slide member 66 to provide stability. Also, as shown in FIGS. 5 and 6, the slide member 66 may include detents 63 extending through slots 61 in the sides of the bracket portion 62 to vertically align the slide member 66 in the bracket portion. These detents may also allow for manual retraction of the slide member 66 (e.g., to release the latch member 40 from the catch member 65 in the event of failure of the latch).

Figure 8:
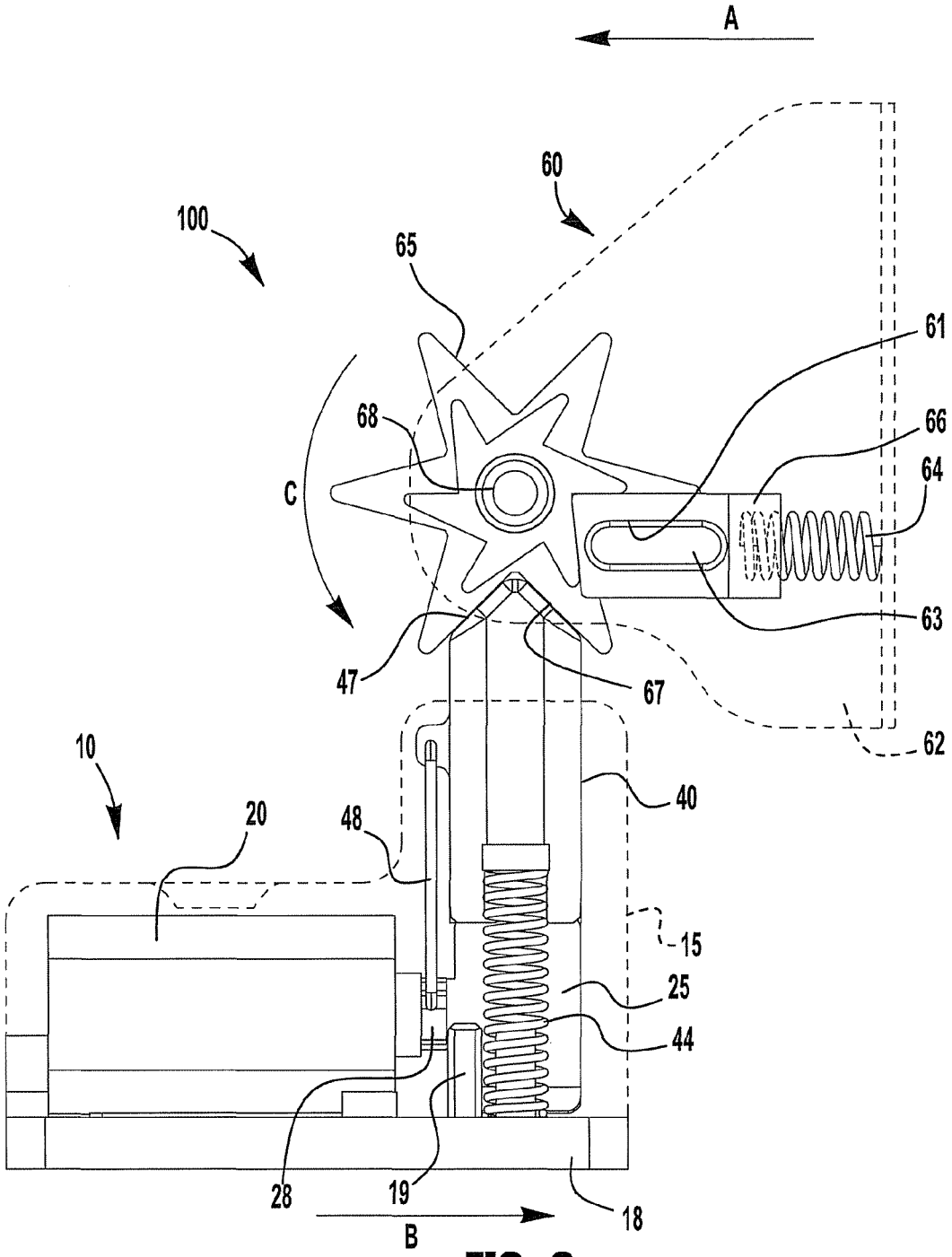
FIG. 8 illustrates a side view of a locking arrangement including the electromechanical latch assembly of FIG. 1 and the ratcheting catch assembly of FIG. 5, with the latch housing and catch bracket shown in phantom to illustrate additional features of the arrangement.

FIG. 8 illustrates a locking arrangement 100 including a latching assembly 10 and a catch assembly 60 shown in locking engagement, according to an exemplary embodiment of the present application. When the catch assembly 60 is laterally moved into locking engagement with the latching assembly 10 (in a direction represented by arrow A), or when the latching assembly 10 is laterally moved into locking engagement with the catch assembly 60 (in a direction represented by arrow B), engagement of the latch member upper portion 47 with one of the latch engaging portions 67 of the catch member 65 rotates the catch member 65 (against biasing slide member 66) in a counter clockwise direction C until the upper portion 47 is fully received in the downward oriented latch engaging portion 67. In this locked condition, the blocking member 25 extends substantially vertically to block retraction of the latch member 40, thereby providing a "deadlocking" feature, as the latch member 40 cannot be manually retracted by a lock pick or other tool. Further, the slide member 66 prevents rotation of the catch member 65 in the clockwise direction to release the latch member 40.

To disengage the latch member 40 from the catch assembly 60, an electrical signal (e.g., in response to an authorized electronic user input) is supplied to the motor 20, which rotates the blocking member 25 approximately 90° to a substantially horizontal orientation, which may result from a relatively brief electrical pulse (e.g., approximately 500 ms). When a lateral separating force is then applied to either of the latching assembly 10 and the catch assembly 60 (e.g., by a user pulling on a cabinet door), lateral force between the latch engaging portion 67 of the catch member 65 and the upper portion 47 of the latch member 40 forces the latch member (now unobstructed by the blocking member 25) downward for disengagement from the catch member 65. This also forces the end of the hook 48 to flex and slide past the hook engaging portion 28 of the blocking member 25. The catch assembly 60 is then free to laterally separate from the latching assembly 10.

When the latch member 40 has laterally separated from the catch member 65, spring members 44 force the latch member 40 upward. As the latch member 40 travels upward, the hook 48 engages the hook engaging portion 28 of the blocking member 25 and rotates the blocking member until the blocking member abuts the post 19 in the latch member blocking position.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

I claim:

1. An electrically operable latch comprising:

a housing;

a latch member assembled with the housing for movement between an extended position adapted to place the electrically operable latch in a latched state, and a retracted position adapted to place the electrically operable latch in an unlatched state;

a blocker member disposed in the housing and adapted to block movement of the latch member from the extended position to the retracted position when the blocker member is in a first position, the blocker member further being adapted to permit movement of the latch member from the extended position to the retracted position when the blocker member is in a second position;

an actuator member disposed in the housing and adapted to move the blocker member from the first position to the second position in response to an electrical signal supplied to the actuator member; and a blocker return member directly connecting the blocker member with the latch member for movement therewith, such that the latch member moves the blocker member from the second position to the first position as the latch member moves from the retracted position to the extended position, wherein the blocker return member comprises a hook member configured to engage a hook engaging portion of the blocker member to move the blocker member from the second position to the first position when the latch member is moved from the retracted position to the extended position, the hook member further being configured to remain disengaged from the hook engaging portion when the latch member is moved from the extended position to the retracted position.

2. The electrically operable latch of claim 1, wherein the latch member is spring-biased to the extended position.

3. The electrically operable latch of claim 1, wherein the actuator member is adapted to rotate the blocker member from the first position to the second position.

4. The electrically operable latch of claim 3, further comprising an obstruction disposed within the housing to prevent rotation of the blocker member beyond the first position by the blocker return member.

5. The electrically operable latch of claim 1, wherein an upper portion of the latch member is tapered, such that a lateral force applied to the latch member directs the latch member toward the retracted position.

6. The electrically operable latch of claim 5, wherein the upper portion of the latch member is substantially V-shaped.

7. The electrically operable latch of claim 1, wherein the blocker return member is configured to move the blocker member from the second position to the first position without electricity.

8. The electrically operable latch of claim 1, wherein the blocker member directly engages the latch member to block movement of the latch member from the extended position to the retracted position when the blocker member is in the first position.

9. The electrically operable latch of claim 1, wherein the blocker member engages a rearmost surface of the latch member to block movement of the latch member from the extended position to the retracted position when the blocker member is in the first position.

10. A latching arrangement comprising:

an electrically operable latch comprising:

a housing;

a latch member assembled with the housing for movement between an extended position and a retracted position;

a blocker member disposed in the housing and adapted to block movement of the latch member from the extended position to the retracted position when the blocker member is in a first position, the blocker member further being adapted to permit movement of the latch member from the extended position to the retracted position when the blocker member is in a second position; and an actuator member disposed in the housing and adapted to move the blocker member from the first position to the second position in response to an electrical signal supplied to the actuator member; and a ratcheting catch comprising:

a bracket member;

a catch member rotatably mounted to the bracket member for rotation about a central axis, the catch member including a plurality of latch engaging portions, wherein an upper portion of the latch member is configured to engage one of the plurality of latch engaging portions when the latch member is in the extended position; and a slide member assembled with the bracket member and spring-biased toward engagement with the catch member, the slide member including a first interengaging surface oriented to engage a corresponding first interengaging surface of the catch member, such that a first rotational force applied to the catch member retracts the slide member to permit rotation of the catch member in a first rotational direction, the slide member further including a second interengaging surface oriented to engage a corresponding second interengaging surface of the catch member, such that the slide member blocks rotation of the catch member in a second rotational direction opposite the first rotational direction when a second rotational force opposite the first rotational force is applied to the catch member.

11. The arrangement of claim 10, wherein the electrically operable latch further comprises a blocker return member operatively connected with the latch member, the blocker return member being configured to move the blocker member from the second position to the first position when the latch member is moved from the retracted position to the extended position.

12. The arrangement of claim 11, wherein the blocker return member comprises a hook member configured to engage a hook engaging portion of the blocker member when the latch member is moved from the retracted position to the extended position, the hook member further being configured to remain disengaged from the hook engaging portion to move the blocker member from the second position to the first position when the latch member is moved from the extended position to the retracted position.

13. The arrangement of claim 11, wherein the blocker return member is configured to move the blocker member from the second position to the first position without electricity.

14. The arrangement of claim 11, further comprising an obstruction disposed within the housing to prevent movement of the blocker member beyond the first position by the blocker return member.

15. The arrangement of claim 10, wherein the latch member is spring-biased to the extended position.

16. The arrangement of claim 10, wherein the actuator member is adapted to rotate the blocker member from the first position to the second position.

17. The arrangement of claim 10, wherein the second interengaging surface of the catch member is substantially coplanar with the central axis of the catch member.

18. The arrangement of claim 10, wherein the slide member comprises a detent extending through a slot in the bracket member for manual retraction of the slide member.

19. The arrangement of claim 10, wherein the catch member comprises a star-shaped gear.

20. An electrically operable latch comprising:

a housing;

a latch member assembled with the housing for movement between an extended position and a retracted position, the latch member being spring biased to the extended position and including a tapered upper portion, such that a lateral force applied to the latch member directs the latch member toward the retracted position;

a blocker member disposed in the housing and adapted to block movement of the latch member from the extended position to the retracted position when the blocker member is in a first rotational position, the blocker member further being adapted to permit movement of the latch member from the extended position to the retracted position when the blocker member is in a second rotational position;

a motor disposed in the housing and adapted to rotate the blocker member from the first rotational position to the second rotational position in response to an electrical signal supplied to the motor; and a hook member operatively connected with the latch member, the hook member being configured to engage a hook engaging portion of the blocker member when the latch member is moved from the retracted position to the extended position for movement of the blocker member from the second rotational position to the first rotational position, the hook member further being configured to remain disengaged from the hook engaging portion when the latch member is moved from the extended position to the retracted position.

21. The electrically operable latch of claim 20, further comprising an obstruction disposed within the housing to prevent rotation of the blocker member beyond the first position by the hook member.

* * * * *